United States Patent [19]

Guery et al.

[11] Patent Number: 4,644,308

[45] Date of Patent: Feb. 17, 1987

[54] VARIABLE COMPOSITION SWITCHING DEVICE REALIZABLE BY THE ASSEMBLING OF MODULAR ELEMENTS

[75] Inventors: Jean-Pierre Guery, Bezons; Gérald Gashet, Puteaux; Jacques Olifant, Nanterre; Raymond Plumeret, Asnieres, all of France

[73] Assignee: La Telemecanique Electrique, France

[21] Appl. No.: 780,745

[22] Filed: Sep. 27, 1985

[30] Foreign Application Priority Data

Sep. 27, 1984 [FR] France ..... 84 14827

[51] Int. Cl.[4] ..... H01H 67/02

[52] U.S. Cl. ..... 335/128; 200/307; 335/120; 335/131; 335/132; 335/202

[58] Field of Search ..... 335/119, 120, 128, 131, 335/132, 136, 138, 202; 200/293, 307, 330

[56] References Cited

U.S. PATENT DOCUMENTS 2,735,918 2/1956 Darr ..... 200/307 X

FOREIGN PATENT DOCUMENTS 0061382 9/1982 European Pat. Off. ..... 335/202

*Primary Examiner*—A. T. Grimley
*Assistant Examiner*—Jane K. Lau
*Attorney, Agent, or Firm*—William A. Drucker

[57] ABSTRACT

A variable composition switching device realizable by the assembling of modular elements and including at least one circuit breaker module i.e. switch module and at least one control and/or protection module. The circuit breaker module consists of a case with two opposing junction sides allowing for assembly by juxtaposition of several circuit breaker modules, one assembly side comprising a duct orifice of the thruster of the curcuit breaker device and two assembly areas of a control and/or protection module. The control modules include suitable means for activating the thruster.

11 Claims, 7 Drawing Figures

VARIABLE COMPOSITION SWITCHING DEVICE REALIZABLE BY THE ASSEMBLING OF MODULAR ELEMENTS

BACKGROUND OF THE INVENTION

Field of the Invention

The present invention concerns a variable composition switching device enabling various switching operations to be carried out, such as, for example, those of a circuit breaker, contactor, reverse current relay or reversing switch, by the connection of modular elements and, in particular:

of at least one switch module controllable by switch gear on which can be exercised an external control force and of at least one control and/or protection module including suitable operational means for controlling the said switch gear.

More precisely, the switch module can include a switch device comprising, inside a case, at least one fixed contact element, at leat one mobile contact element connected to the said switch gear and able to take up at least two positions, i.e. a first position in which the mobile contact element is applied against the fixed contact element (closed state) and a second position in which the mobile contact element is separate from the fixed contact element (open state) and flexible means exerting on the moving armature a force tending to lead the mobile contact element into one or other of the said two positions.

Moreover, the control and/or protection modules used in the previously described switching device can be of at least two different types, namely:

direct control modules including means of control producing by themselves alone a sequence with sufficiently high energy and speed to ensure correct switching of the switching device, such control means being suitable for acting directly on the switch gear of the switch modules;

indirect control modules each comprising one or more control and/or detection elements producing a control sequence with insufficiently high energy and/or speed to ensure correct switching of the switching device and which act on the switch gear of the switch modules by means of a potential energy accumulation releasing device.

For information, the direct control modules may include an automatic control device capable of including in its most simple version only an all or nothing electro-magnet whose mobile armature is coupled to a mechanical transmission device suitable for cooperating with the switch gear of at least one switch module. It is clear, however, that this automatic control module could also be of the bistable type, indeed even tristable, with control by pulses (trip switch mode), with sequence storage, etc. Furthermore, it may include AC/DC converter feed circuits for example, or analgous circuits (operation for one or more thresholds) etc.

These direct control modules can also include several electromagnets acting on the same mechanical transmission device.

The control and/or detection elements used in the indirect control modules can, for example, include excess current detectors, devices for detecting a prolonged intensity rise, detectors of a fault established in the line or in a device fed by the line, and/or manual control devices.

As previously mentionned, these control and/or detection elements act on the release switch of a potential energy accumulation releasing device whose electromagnet is designed to exert a control action on the switch gear of at least one switch module.

It has been confirmed that in numerous applications, especially in the case of realization of a reverse current relay, the switching device must include at least one switch module, one direct control module and one indirect control module.

In addition, these control modules must be able to carry out simultaneous control of several switch modules.

OBJECT OF THE INVENTION

The invention therefore offers a variable composition switching device of the above-mentioned type introducing modular elements presenting structures which, when assembled together, can carry out such functions.

SUMMARY OF THE INVENTION

According to the invention, this switching device is more especially characterized in that:

the switch module comprises a case having at least:

- two opposing junction sides against each of which can be assembled by juxtaposition the junction side of another identical switch module,
- an assembly side comprising an orifice for passage or access to the said control device and, on both sides of this orifice, two assembly areas, each fitted with means for fixing a control and/or protection module, and
- control and/or protection modules each comprising a case having at least one assembly side supplied with fixing means suitable for cooperating with the fixing means of one of the assembly areas so that in the fixed position of a control module on an assembly area, the said control means are situated in line with of the said switch gear.

The case with the switching module by advantageously include a support face fitted with a fixing device on a support structure suitable for receiving several switch modules juxtaposed from each other by two respective junction sides.

Moreover, the switching device can include coupling means such as a coupling bar enabling the switch gear of several switch modules, assembled together by juxtaposition, to be mechanically connected in such a way that the switch device of these modules can be operated by one or more control modules.

In addition, where the switching device introduces at least one switch module assembled with two control and/or protection modules, one of which is equipped with at least one auxiliary operating element and the other with at least one auxiliary control element suitable to be operated by the said auxiliary operating element, the cases of the said control and/or protection modules each include an interactive side fitted with a dialogue window. These dialogue sides are then disposed in such a way that, when these two control and/or protection modules are assembled on the two respective assembly areas of the housing of a switch module, the dialogue faces of these two control modules are disposed face to face with the dialogue windows facing each other so as to be able to mechanically connect the auxiliary operating element to the auxiliary control element by means of a mechanical linking passing through the said dialogue windows.

BRIEF DESCRIPTION OF THE DRAWINGS

Some embodiments of the invention are described hereafter by means of examples, by no means restrictive, with reference to the annexed drawings in which.

DESCRIPTION OF THE PREFERRED EMBODIMENT

Figure 1:
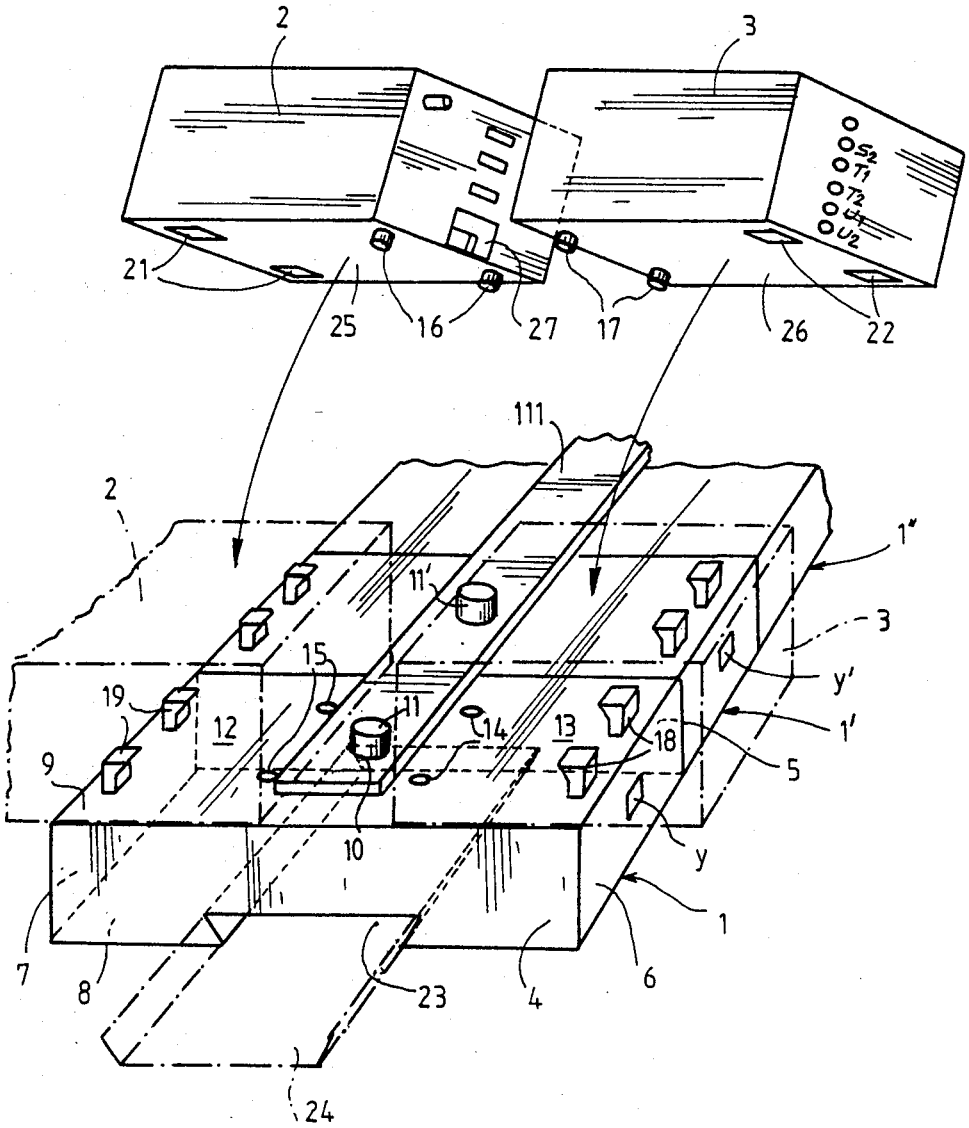
FIG. 1 is a diagrammatic perspective illustrating a mode for assembling several switch modules and several control and/or protection modules.

It should be noted firstly that for drawing clarity, the housings of the switch modules 1, 1', 1'' and the control modules 2, 3 represented on FIG. 1 appear with a roughly parallelpiped form. However, it is clear that this form is not restrictive and that the housings could have different forms.

To be more specific, the housings of switch modules 1, 1', 1'' each comprise:

two opposing parallel junction faces 4, 5;
two lateral faces 6, 7;
a support face 8; and
an assembly face 9 opposite the support face 8.

The assembly face 9 generally includes in its centre an orifice 10 through which the thruster 11 passes which serves to operate the switch device lodged inside the housing 1 as well as, on both sides of this recess, two assembly areas 12, 13, each designed to receive a control module 2, 3.

Each of these assembly area 12, 13 includes means for centering 14, 15 and fixing a control module 2, 3.

In the example represented, these centering means 14, 15 may, for example, consist of recesses in which the dog points 16, 17 provided on the housings of the control modules 2, 3 can be engaged, whilst the means of fixing thus consist of head dog points 18, 19 intented to be snapped into the ratchet devices 21, 22 fitting out the housings of the control modules 2, 3.

The support face 8 of the housing includes an assembly section 23 forming a prismatic concavity with trapezoid section centered perpendicularly to the junction faces 4, 5 so as to allow for the assembly of several switch modules 1, 1', 1'' . . . juxtaposed at their junction face 4, 5 on a given profiled support rail 24 (diagrammatically represented).

Moreover, the lateral faces 6, 7 of the housings of the switch modules 1, 1' . . . can be equipped with connection means x,y–x',y' . . . designed to be connected to the current feeders of the switch devices accomodated in these housings.

In this example, the housings of control modules 2, 3 each comprise an assembly face 25, 26 equipped with centering 16, 17 and fixing 21, 22 devices suitable for cooperating with the corresponding devices 14, 15–18, 19 provided on each of the assembly areas 12, 13 of the housings of the switch modules 1, 1', 1'' . . . .

They also include a duct orifice 27, 28 of an operating lever 29, 30 disposed in such a way that once a control module 2, 3 is assembled on an assembly area 12, 13 of a switch module 1, 1', 1'', its operating lever 29, 30 extends in line with thruster 11 and can cooperate with the latter.

Of course, these duct orifices 27, 28 could be disposed otherwise, for example inside an assembly face 25, 26. In addition, the duct orifices 27 of the control housings 2 can be offset in relation to the duct orifices 28 of the control housing 3 so as to avoid the lever of one of these modules coming into contact with the lever of another module and thus making assembly impossible.

In order to allow for simultaneous operation of the switch modules by the control modules, the thrusters 11, 11' are joined to each other by means of a linking bar 111 which extends parallel to the longitudinal axis of the support rail 24.

The faces 42, 43 of the control housings 2, 3 which are opposite the dialogue faces 32, 33 are fitted with connection devices $A_1$, $A_2$, $B_1$, $B_2$, $S_1$, $S_2$, $T_1$, $T_2$ whose role will be defined subsequently.

Figure 2:
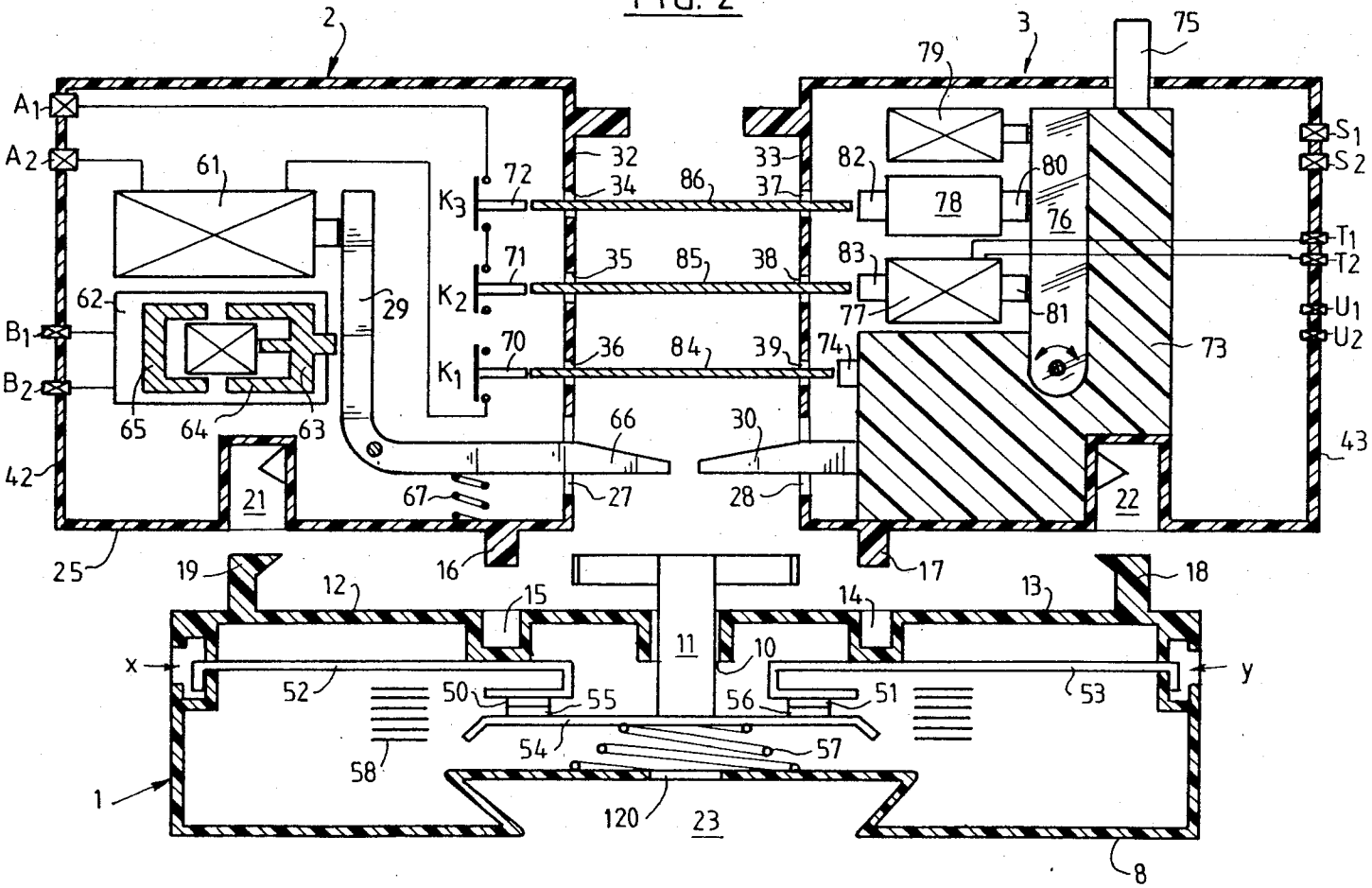
FIG. 2 is a diagrammatic sectional drawing illustrating an assembly of two control modules on a switch module.

The switch devices accomodated in the housings of the switch modules may be of the type represented on FIG. 2 which normally includes:

two fixed contact elements 50, 51 carried by two respective conductors 52, 53 (or power leads) mounted on the upper wall of the assembly face of the housing, a moving armature, comprising a mobile contact carrier 54 in an electrically conducting materal and on which are mounted two mobile contact elements designed to cooperate with the respective fixed contact elements 55, 56, a control device (thruster 11) linked to the mobile contact carrier 54 and passing through the orifice 10 provided in the assembly face of the housing, a spring 57 disposed between the lower wall 14 of the housing and the mobile contact carrier 54 so as to exert a force tending to lead the mobile contact elements 55, 56 into contact with the fixed contact elements 50, 51.

Of course, this switch can also include all the equipment with which switches are usually supplied such as, for example, fractination flyers of arcs 58, decompression channels, etc. Moreover, the conductors 52, 53 present a doubled form allowing for the development of repelling powers acting on the mobile contact carrier 54 under the influence of the current circulating inside the switch.

It is clear that, owing to the action of the spring 57, this switch device is normally found in the closed position, opening then being effected by exerting on the thruster 11 a pressure opposed to that of the spring 57.

In the example shown on FIG. 2, the switch module 1 is equipped with a direct control module 2 and an indirect control module 3, the whole unit constituting a reverse current relay.

The direct control module comprises, accomodated inside the housing, two electromagnets 61, 62 whose mobile armatures 63 (only one of which has been represented) are coupled to the oscillating lever 29, an arm 66 of which passes through the housing by the orifice 27 and cooperates with the thruster 11. The electromagnet 61 operates on automatic control, whilst the electromagnet 62 can, for example, form part of a low-voltage control circuit.

The functioning of this control module 2 is then as follows:

in the excited state, the mobile armature 54 of the electromagnets 51, 52 is applied against the fixed armatures 55 making, thanks to the spring 67, the lever 29 rotate which frees the thruster 11; under the effect of the spring 57, the mobile contact elements 55, 56 are applied onto the fixed contact elements 50, 51; the switch is then in the closed state, as soon as the current ceases to circulate inside one or other of the electromagnets, the mobile armature 64 of this electromagnet which is attracted by a spring (not represented) deviates from the fixed armature 65 and trips the lever 29 which then forces back the thruster 11 in opposition to the action of the spring 57 and provokes the passage of the switch into the open state.

The supply of the coil of the electromagnet 62 is made by the terminals B1 and B2, whilst the supply of the coil of the electromagnet 61 is made by the terminals $A_1$, $A_2$ by means of a circuit comprising, in series, three auxiliary opening contacts $K_1$, $K_2$, $K_3$, whose thrusters 70, 71 and 72 are disposed inside the axis of the dialogue windows 34, 35, 36.

The indirect control module, for its part, includes a potential energy accumulation release device 73 comprising:

an operating lever 30 cooperating with the thruster 11;

an auxiliary operating thruster 74 operated in synchronism with the lever 30, this thruster being disposed to the right of the dialogue window 39;

a reset thruster 75 passing through an opening provided on the upper face of the housing; and a release device made up of an oscillating lever 76 whose rotation is controlled by three protection devices, namely a device for protection against sudden excess currents 77, a detection device sensitive to any fault verified in the line or in any device fed by the line 78 and a device 79 for protection against prolonged intensity rises.

This release device is designed so as to present two stable states, i.e. a set state and a released state, as well as two transitory phases, i.e. a reset phase obtained by an action on the reset thruster and a release phase obtained by an action on the oscillating lever 76.

The operating lever 30 and the thruster 74 may successively take two stable positions corresponding to the two stable states, namely:

a triggered position in which the lever 30 exerts on the thruster 11 an action in opposition to that of the spring 57 so as to ensure that the switch is kept in the open state and in which the thruster 74 is in the outspread state, and a reset position in which the lever 30 authorizes the return of the switch to the closed state in which the thruster is in the re-entered state.

Of course, the release device also includes means for potential energy accumulation appropriate for storing a fraction of the potential energy exerted on the thruster 75 at the time of the reset phase and for then returning it to the lever 30 and thruster 74 at the time of the release phase.

The protection devices 77, 78 each include a thruster 80, 81 cooperating with the oscillating lever 76 and an auxiliary thruster 82, 83 disposed in line with the dialogue windows 37, 38.

The auxiliary thrusters 74, 82, 83 can be advantageously employed by coupling them to the thruster 70, 71 and 72 of the auxiliary contacts $K_1$, $K_2$, $K_3$ by means of link rods 84, 85, 86 passing through the dialogue windows 34, 35, 36 of the control module 2 and the dialogue windows 37, 38, 39 of the control module 3.

It should be noted that the electric links of the protection devices 77, 78 and 79 may be respectively provided by means of the connections terminals $S_1$, $S_2$ - $T_1$, $T_2$ - $U_1$, $U_2$ situated at the side of the control module 3 opposte the dialogue face 33.

Figure 3:
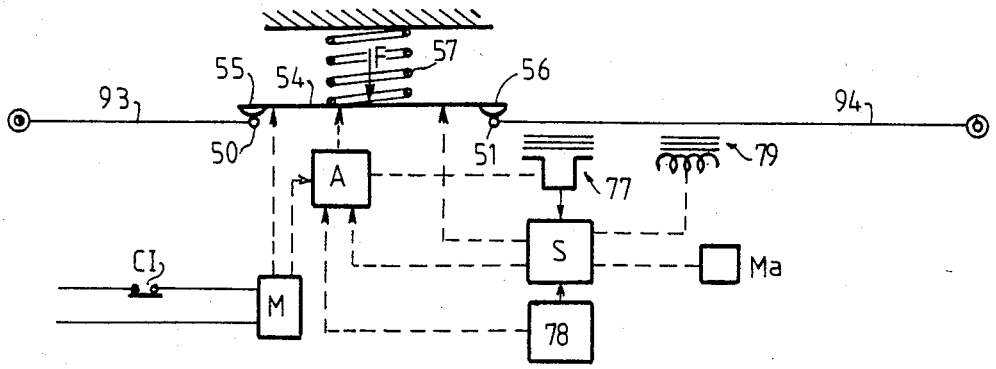
FIG. 3 is an electromechanical diagram illustrating different operations which can be carried out using the switching device represented in FIG. 2.

FIG. 3 is a theoretical diagram of a high cut-off power contactor realizable from a structure such as the one represented by FIG. 2.

Figure 4:
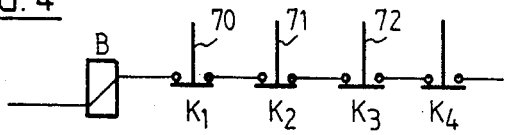
FIG. 4 is a diagrammatic representation of the feed circuit of the coil of the electromagnet used in the device of FIG. 3.

In this example, the switch includes at least two fixed contact elements 50, 51 connected to two parts, 93, 94 of a current transmission line. To these two fixed contact elements 50, 51, are connected two mobile contact elements 55, 56 mounted on a mobile contact carrier 54 attracted by a spring 57 which exerts a force F tending to reclose the switch. The opening of this switch can be provoked by a plurality of means capable of exerting on the moving armature 54 a force in opposition to that of the spring 57 and of higher value. In this example, these means include more especially:

an automatic control device A (control module 2) consisting of the electromagnet 61 represented on FIG. 2; this control device may in addition include the auxiliary contacts $K_1$, $K_2$, $K_3$ connected in series in the feed circuit of the coil B of the electromagnet, as represented in FIG. 4;

a control device M sensitive to a low voltage, for example on the control circuits, the contact referenced CI representing control through lack of voltage; the device can include an electromagnet of the type of 62 represented on FIG. 2 and which also carries out the control of a fourth auxiliary contact $K_4$ in series in the circuit of the coil B;

a releasing device S of the type previously described whose trigger is controlled by the excess current detector 79, by a detection device 77 of a prolonged intensity rise, by a fault detector 78 sensitive to any fault verified in the line or in a device fed by the line, this fault detector being capable of having an instantaneous or time-lagged action, direct or decompounded, etc. . . , and by a manual control device Ma.

The release device S can also activate, thanks to a mechanical (auxiliary thruster 74, rod 84) or electrical link, the auxiliary switch K1 so as to provoke cutoff of the circuit which feeds the coil of the electromagnet of the automatic control device A, with a view to confirming cutoff of the switch provoked by the releasing device S.

Similarly, the detection device 77, the fault detector 78 and the control device M can act in a similar way on the auxiliary contacts $K_2$, $K_3$, $K_4$ of the feed circuit of the coil B.

It should be mentioned that the electrical links between the current line 94 and the protection devices 77, 79 can be made by means of the connectors $S_1$, $S_2$ - $U_1$, $U_2$ provided on the housing.

Figure 5:
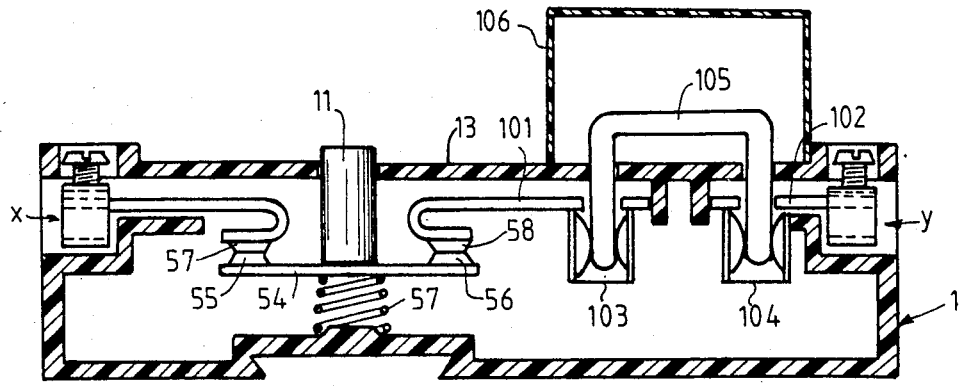
FIG. 5 represents a variant of the switch module.
Figure 6:
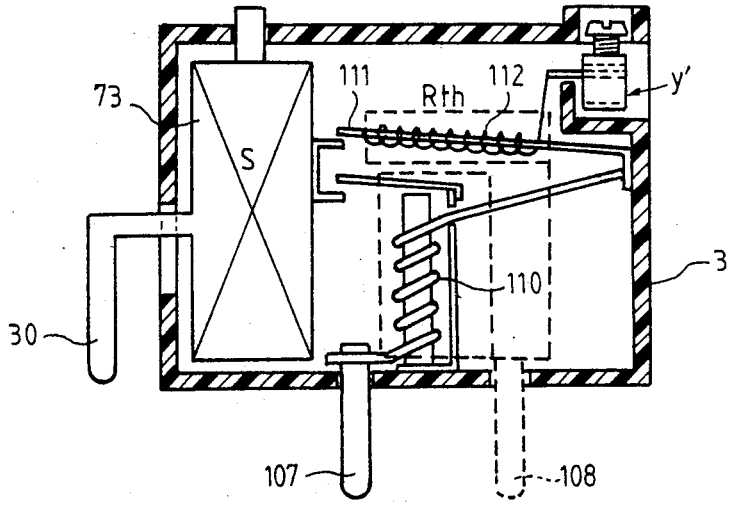
FIG. 6 represents a variant of an indirect operation control module adapted to the switch module shown in FIG. 5.

However, these links can be more effectively made according to the arrangements shown on FIGS. 5 and 6.

Thus, as represented on FIG. 5, the switch module 1 includes a power lead realized in two parts 101, 102 comprising two female connectors 103 and 104 respectively. These two connectors 103, 104 which enter the assembly area 13 of the housing can receive a conductor jumper link 105, protected by an insulating cover 106, which ensures electrical continuity between the two parts 101 and 102.

Furthermore, the indirect control module 13 includes two conductor pins 107, 108 disposed on the assembly face 26 of the housing in such a way as to be able to engage the female connectors 103, 104 at the time of assembly of the indirect control module 3 onto the switch module 1.

The two pins 107, 108 are respectively connected to the protection devices (magnetothermal) which include, in this specific case, an electromagnet 110 and a bimetallic strip 111 heated by a thermal resistor 112.

Thus, when the switch module 1 alone is used or connected to a direct control module, the power line is connected with the connection terminals x and y and the jumper link is coupled to the female connectors 103, 104. Of course, in this case, when the switching device of the module 1 (or when the line) is idle owing to upstream cutoff, the off-load jumper link can be withdrawn and thus ensure cutoff of the power line.

Of course, when the switching device of the module 1 is multipolar and, in this case, its moving armature 54 carries several pairs of mobile contact elements 55, 56 cooperating with several pairs of fixed contact elements, respectively 57, 58, so as to form so many contacts each connected to a respective line, it is necessary to provide, for each line, a unit introducing a power lead in two parts 101, 102, two female connectors 103, 104, a conductor jumper link 105 or a pair of pins 107, 108 provided on the corresponding indirect control module 3.

It should be noted that in the example represented by figure 6, the indirect control module 3 includes a terminal y' capable of being connected to a connection terminal y of the switching device 1 on the power line.

This terminal y' is itself connected to the pin 107 by means of the resistor 112, the bimetallic strip 111 and the electromagnet 110. In this case, the pin 108 is not used and can be eliminated.

This solution, which limits line drops to the maximum, will preferably be used in the case of high currents.

On the other hand, in the case of sufficiently weak currents, the terminal y' is not necessary and the resistor 112 can be fed by means of its linkage to the pin 108.

Of course, the invention is not restricted to the modes of assembly previously described.

Figure 7:
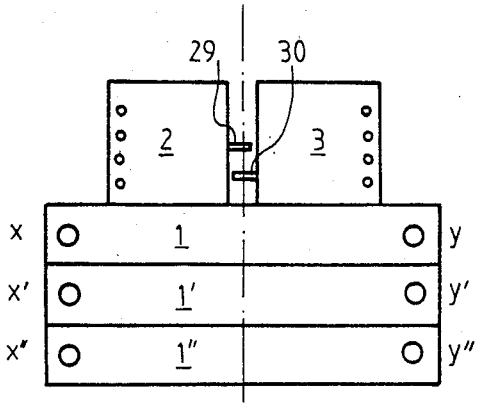
FIG. 7 is a diagrammatic representation illustrating another mode of assembly for the switching device according to the invention.

Thus, for example, the switch modules 1, 1', 1'' could be stacked on top of each other, as shown in FIG. 7, the assembly face of one of the switch modules being assembled on the support face of another switch module.

In this case, the control modules 2 and 3 are connected to the assembly face of the switch module situated at the top of the pile.

These control modules can then have their operating levers 29, 30 offset in height, and it would be advisable to provide a transmission device connecting the moving armatures of these switches, once they have been stacked together and to the operating levers 29, 30.

The linking of the moving armatures 54 can be made quite simply by providing, on the support face of the modules 1, an orifice 120 (FIG. 2) laid out in such a way that in a stacking, the thruster 11 of these modules 1 passes through this orifice 120 and naturally comes to rest on the moving armature 54 (or a part mounted on the latter) of the module 1 directly mounted on the assembly face 12.

What is claimed is:

1. Variable composition switching device realizable by the assembly of modular elements and in particular of at least one switch module comprising a switching device controllable by switch gear on which can be exerted an external control force, and at least one control and/or protection module comprising suitable means of operation to apply to the said switch gear a control force, characterized in that the switch module comprises a housing having at least:

two opposing junction faces against each of which can be assembled, by juxtaposition, the junction face of another identical switch module, an assembly face comprising an orifice for passage or access to the said switch gear and, on both sides of this orifice, two assembly areas each fitted with fixing devices of a control and/or protection module, and the control and/or protection modules each comprising a housing with at least one assembly face supplied with fixing devices suitable for cooperating with the fixing devices of one of the assembly areas so that in the fixed position of a control module on an assembly area, the said operating devices are situated in line with the said switch gear.

2. Device according to claim 1, characterized in that the housing of the switching module also includes a support face fitted with a device for fixing the said module onto a support structure.

3. Device according to claim 2, characterized in that the fixing device and the said support structure are designed in such a way as to receive several switch modules juxtaposed in relation to each other by two respective junction faces.

4. Device according to claim 1, characterized in that it includes coupling devices suitable for mechanically connecting the switch gear of several switch modules assembled together by juxtaposition in such a way that the switching devices of these modules can be operated simultaneously by one or more control modules.

5. Device according to claim 1, characterized in that the fixing devices provided on the fixing areas and on the control and/or protection modules consist of assembly latching devices.

6. Device according to claim 1 introducing at least one switch module assembled with two control and/or protection modules one of which is equipped with at least one auxiliary control element and the other being equipped with at least one auxiliary contact suitable for being operated by the said auxiliary control element, characterized in that the housings of the said control and/or protection modules each comprise a dialogue face supplied with at least one dialogue window giving access, according to the case, to the said auxiliary control element or to the said auxiliary contact element, and in that the disposition of the said control modules is such that when these modules are assembled on the two assembly areas of the housing of the switch module, the dialogue faces face each other and the corresponding dialogue windows are in line with each other so as to be able to connect the said auxiliary control element to the said auxiliary contact element by means of a mechanical link passing through the said dialogue windows.

7. Device according to claim 6 introducing at least one switch module connected to a direct control module comprising at least one automatic control electromagnet whose coil is fed by a circuit comprising at leat one auxiliary contact connected to a dialogue window, and to an indirect control module comprising at least one control and/or protection device acting on the operating device of the switch module by means of a potential energy release device, characterized in that the release device includes an auxiliary control element connected to a dialogue window and suitable for ensuring control of the said auxiliary contact by means of a mechanical transmission device.

8. Device according to claim 6 introducing at least one switch module connected to a direct control module comprising at least one automatic control electromagnet whose coil is fed by a circuit comprising at least one auxiliary contact, and to an indirect control module comprising at least one control and/or protection device acting on the operating device of the switch module by means of a potential energy release device, characterized in that the said control and/or protection device includes an auxiliary control element connected to a dialogue window and suitable for ensuring the control of the said auxiliary contact by means of a mechanical transmission device.

9. Device according to claim 1, characterized in that it includes a switch module whose switching device comprises a power lead in two parts with two female conductors entering one of the said assembly areas and on which can be connected:

a conductor jumper link ensuring electrical continuity between the said two parts, or two pins provided on the assembly face of a control module.

10. Device according to claim 1, characterized in that the above-mentioned switch modules include moving armatures and devices enabling them to be assembled by stacking with the result that the assembly face of one of the switch modules is assembled on the support face of another switch module, in that, in this case, the said control modules are mounted on the assembly face of the switch module situated at the top of the stack, and in that the said switch modules comprise mechanical linking devices for mechanically linking their moving armatures.

11. Device according to claim 10, characterized in that the above-mentioned mechanical linking devices include an orifice provided on the support face of the switch modules and disposed in such a way that, once a stacking is effected, the switch gear of one of these modules passes through this orifice and comes to rest on the moving armature of the switch module mounted directly on its assembly face.

* * * * *